US008123438B2

(12) United States Patent
Pallini et al.

(10) Patent No.: US 8,123,438 B2
(45) **Date of Patent: *Feb. 28, 2012**

(54) RAM STYLE TENSIONER

(75) Inventors: Joseph W. Pallini, Tomball, TX (US); Edward A. Mendoza, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/814,701

(22) Filed: Jun. 14, 2010

(65) Prior Publication Data

US 2010/0254767 A1 Oct. 7, 2010

Related U.S. Application Data

(63) Continuation of application No. 12/629,704, filed on Dec. 2, 2009, now Pat. No. 8,011,858, and a continuation of application No. 11/970,974, filed on Jan. 8, 2008, now Pat. No. 7,632,044.

(60) Provisional application No. 60/879,275, filed on Jan. 8, 2007.

(51) Int. Cl.
*E21B 19/00* (2006.01)

(52) U.S. Cl. ..... 405/224.4; 405/224.2

(58) Field of Classification Search ..... 405/224.4, 405/224.3, 224.2, 224, 223.1; 166/367
See application file for complete search history.

(56) References Cited

U.S. PATENT DOCUMENTS

| | | | | |
|---|---|---|---|---|
| 4,100,752 | A | 7/1978 | Tucker | |
| 4,787,778 | A | 11/1988 | Myers et al. | |
| 5,069,488 | A | 12/1991 | Freyer et al. | |
| 5,366,324 | A | 11/1994 | Arit | |
| 5,551,803 | A | 9/1996 | Pallini, Jr. et al. | |
| 6,746,182 | B2 | 6/2004 | Munk et al. | |
| 7,112,011 | B2 | 9/2006 | McCarty et al. | |
| 7,329,070 | B1 | 2/2008 | Trent et al. | |
| 7,334,967 | B2 | 2/2008 | Blakseth et al. | |
| 7,632,044 | B2 * | 12/2009 | Pallini et al. | 405/224.4 |
| 2005/0074296 | A1 | 4/2005 | McCarty et al. | |
| 2005/0123359 | A1 | 6/2005 | McCarty et al. | |
| 2005/0129464 | A1 | 6/2005 | Moncus | |
| 2005/0147473 | A1 | 7/2005 | Pallini et al. | |
| 2007/0048094 | A1 | 3/2007 | Mao et al. | |
| 2008/0205992 | A1 | 8/2008 | Ellis et al. | |

FOREIGN PATENT DOCUMENTS

EP 0088608 A3 9/1983

* cited by examiner

*Primary Examiner* — Frederick L Lagman
(74) *Attorney, Agent, or Firm* — Potomac Patent Group PLLC

(57) ABSTRACT

A riser tensioner configured to apply a tension to a riser. The riser tensioner includes a frame configured to be fixedly attached to the riser; plural cylinder assemblies spaced around the riser, each cylinder assembly having a cylinder and a piston configured to slidably move inside the cylinder, the piston being configured to connect to the frame; a guide roller support stationarily mounted to and extending from the frame; at least one bearing fixedly attached to the guide roller support; and a guide member configured to be in rolling engagement with the at least one bearing as the cylinder moves relative to the frame.

23 Claims, 3 Drawing Sheets

RAM STYLE TENSIONER

CROSS-REFERENCE TO RELATED APPLICATIONS

This application claims priority to U.S. patent application Ser. No. 12/629,704, filed Dec. 2, 2009 which is a continuation of U.S. patent application Ser. No. 11/970,974, filed Jan. 8, 2008 and issued as U.S. Pat. No. 7,632,044 on Dec. 15, 2009, which claims priority to provisional patent application 60/879,275, filed Jan. 8, 2007.

FIELD OF THE INVENTION

This invention relates generally to tensioner assemblies and in particular to a riser tensioner assembly associated with a riser extending from subsea well equipment to a floating platform.

BACKGROUND OF THE INVENTION

A floating production platform is often used for deep water offshore oil and gas production. One or more risers extend from subsea equipment on the sea floor, such as a manifold or subsea production tree. The riser extends through an opening in the platform. A riser tensioner is mounted on the platform to apply and maintain tension in the riser.

The tensioner typically comprises a plurality of pistons and cylinders mounted between the platform and a frame secured to the riser. Fluid pressure is applied to the cylinders to apply tension to the riser. The platform moves toward and away from the subsea equipment in response to waves and currents. The riser, of course, is relatively stationary at the surface, so the movement of the platform causes the pistons and cylinders to stroke inward and outward.

To avoid damage to the riser due to platform movement, guide rollers may be employed to engage the riser or a conductor pipe surrounding an upper portion of the riser. The guide rollers are typically mounted to the platform for movement in unison with the platform.

SUMMARY

According to an exemplary embodiment, a floating facility is configured to apply a tension to a riser. The floating facility includes a frame configured to be fixedly attached to the riser; a platform including an upper deck and a lower deck, the upper deck and the lower deck having an opening configured to allow the riser to pass through the platform; plural cylinder assemblies spaced around the opening, each cylinder assembly having a cylinder and a piston configured to slidably move inside the cylinder, the plural cylinder assemblies movably connecting the frame to the platform; a guide member fixedly attached to the platform; a guide roller support stationarily mounted to and extending from the frame; and at least one bearing fixedly attached to the guide roller support and configured to be in rolling engagement with the guide member as the platform moves relative to the frame.

According to another exemplary embodiment, a floating facility is configured to apply a tension to a riser. The floating facility includes a frame configured to be fixedly attached to the riser; a platform having an opening configured to allow the riser to pass through the platform; plural cylinder assemblies spaced around the opening, at least one cylinder assembly having a cylinder and a piston configured to slidably move inside the cylinder, the at least one cylinder assembly movably connecting the frame to the platform; a guide member fixedly attached to the platform; and at least one bearing fixedly attached to the frame and in rolling engagement with the guide member as the platform moves relative to the frame.

According to still another exemplary embodiment, there is a tensioner assembly for supporting a riser extending downwardly from a platform to a subsea wellhead. The tensioner assembly includes a tension frame having a moveable guiding, stabilizing assembly for slidably engaging a track attachable to the platform for preventing lateral movement of the tensioner assembly due to a movement of a vessel; a first deck for supporting a plurality of cylinders; a plurality of pistons wherein each of the plurality of pistons engages the tension frame on one end; and a second deck securely supporting the track. The plurality of cylinders are secured to the first deck on one end and the plurality of cylinders is concentrically disposed around the downwardly extending riser from the tension frame, and each of the plurality of cylinders is adapted for receiving one of the plurality of pistons. The tension frame is configured to move from a fully retracted position to a fully extended position and a plurality of positions therebetween using the moveable guiding, stabilizing assembly engaging the track and preventing lateral movement of the tension frame due to a movement of the vessel.

According to yet another exemplary embodiment, there is a riser tensioner configured to apply a tension to a riser. The riser tensioner includes a frame configured to be fixedly attached to the riser; plural cylinder assemblies spaced around the riser, each cylinder assembly having a cylinder and a piston configured to slidably move inside the cylinder, the piston being configured to connect to the frame; a guide roller support stationarily mounted to and extending from the frame; at least one bearing fixedly attached to the guide roller support; and a guide member configured to be in rolling engagement with the at least one bearing as the cylinder moves relative to the frame.

DETAILED DESCRIPTION OF THE INVENTION

Figure 1:
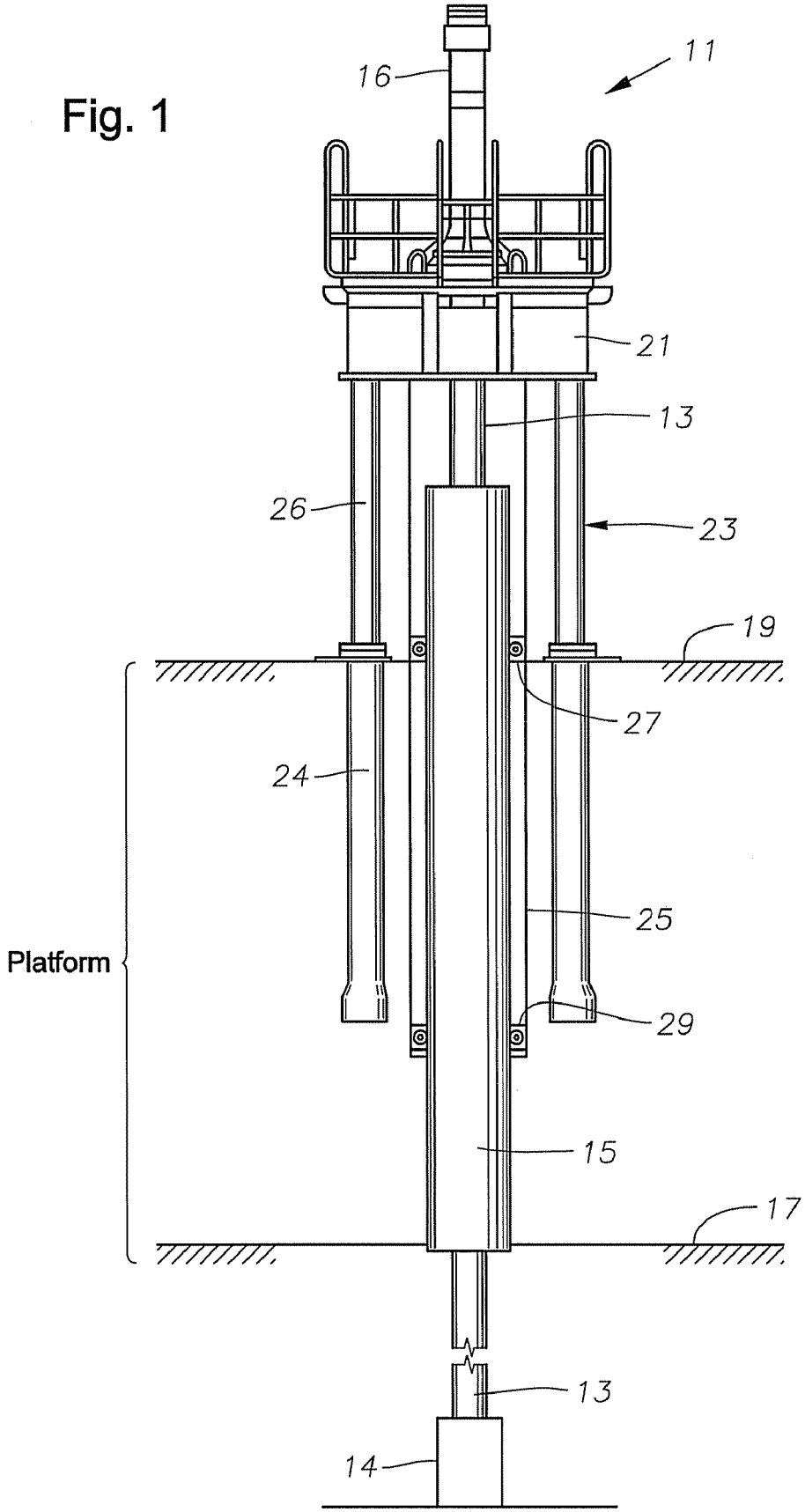
FIG. 1 is a schematic view of a riser tensioner assembly, built in accordance with the present invention, and in an intermediate position.

Referring to FIG. 1, a riser tensioner assembly 11 is associated with a riser 13 extending between subsea well equipment 14 on the sea floor and a floating production facility or platform at the surface. The subsea well equipment 14 may be a subsea wellhead, production tree, manifold or other facilities for conveying well fluids to the floating production facility. The lower end of riser 13 is stationarily mounted to subsea well equipment 14. Riser 13 is fixed in length and extends upward from subsea well equipment 14 through an opening in the floating platform.

In this embodiment, riser 13 extends through a conductor or guide member 15 mounted stationarily on the production facility. Guide member 15 is preferably tubular and has an inner diameter larger than an outer diameter of riser 13. Riser 13 extends above guide member 15 to a riser mandrel 16 for interfacing with equipment on the production facility. The lower end of guide member 15 may be located at the bottom of the floating production facility.

The platform preferably includes a lower deck 17 that is rigidly connected to guide member 15 such that guide member 15 is stationary relative to lower deck 17 and the rest of the platform. The platform also has an upper deck 19 that is a fixed distance from lower deck 17. In this example, upper deck 19 serves as a base for riser tensioner assembly 11 to actuate from.

Figure 2:
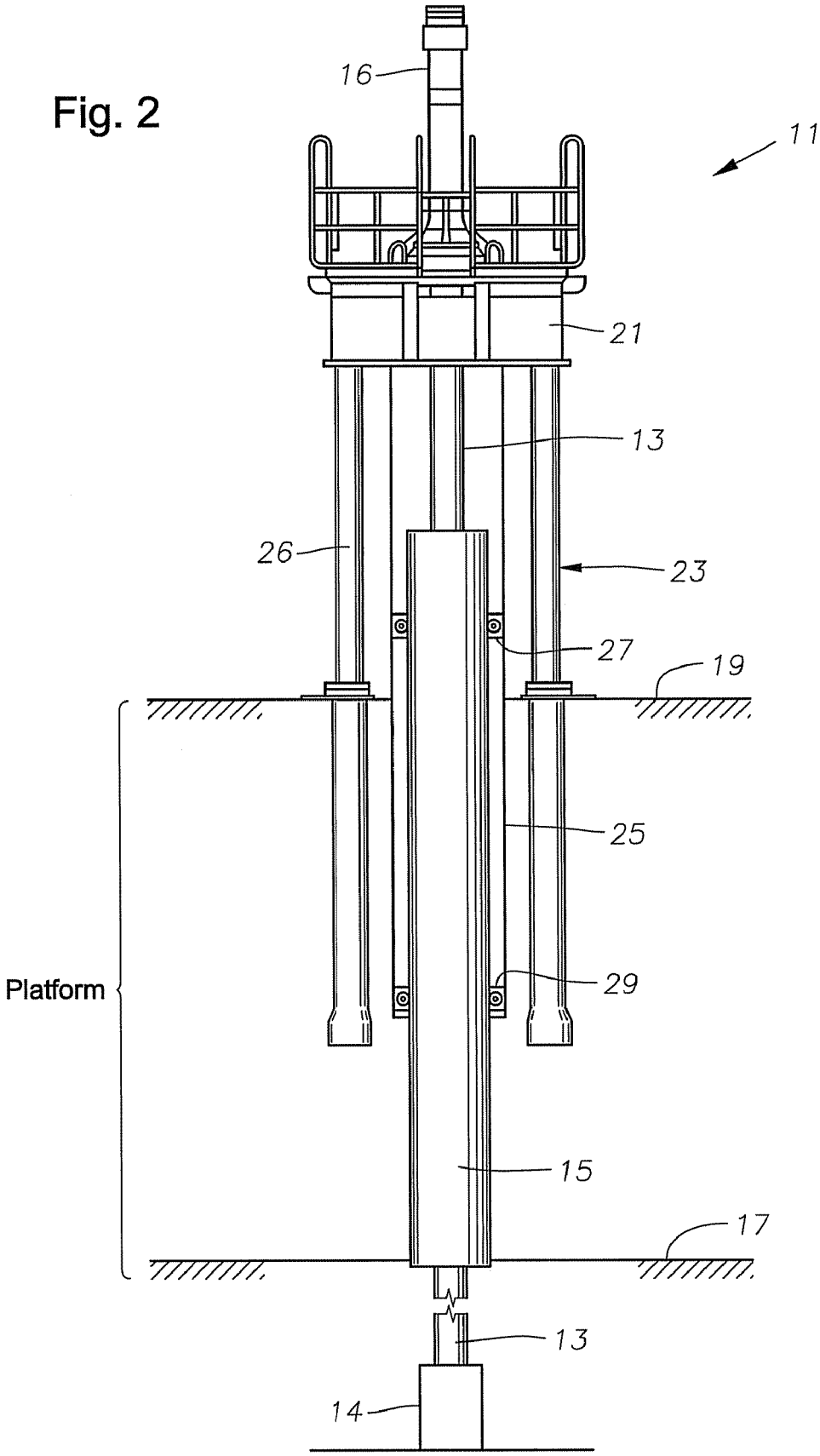
FIG. 2 is a schematic view of the riser tensioner assembly of FIG. 1, in an extended position.
Figure 3:
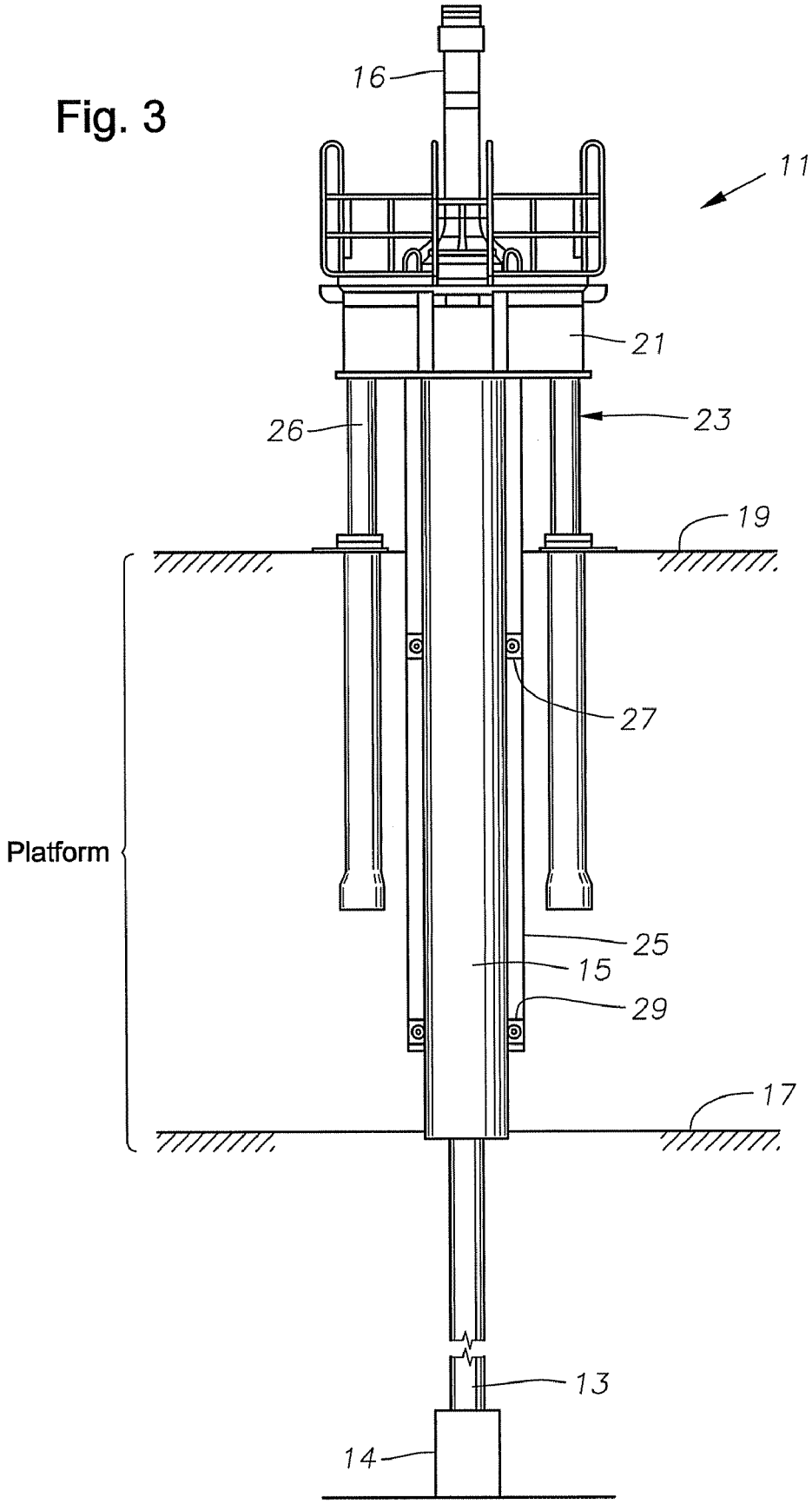
FIG. 3 is a schematic view of the riser tensioner assembly of FIG. 1, in a retracted position.

Riser tensioner assembly 11 preferably includes a top frame 21 positioned above upper deck 19 and stationarily mounted to riser mandrel 16. A plurality of hydro-pneumatic cylinder assemblies 23 extend axially downward from frame 21 and connect to upper deck 19. In the preferred embodiment, cylinder assemblies 23 are circumferentially spaced around riser 13. Each cylinder assembly 23 comprises a cylinder or cylinder 24 and a piston 26 such that cylinder assemblies 23 actuate between an extended position as shown in FIG. 2 and a retracted position as shown in FIG. 3. Preferably each cylinder 24 is mounted stationarily to upper deck 19 and the upper end of each piston 26 is mounted to frame 21. However, that arrangement could be reversed. Cylinder assemblies 23 exert an upward tensile force on riser 13 and help to alleviate changes in axial loads on riser 13 due to movement of the production facility toward and away from subsea equipment 14 in response to waves and currents.

A guide roller or bearing support 25 extends downward from frame 21 around an upper portion of guide member 15. In the example shown, guide roller support 25 comprises frame members or braces spaced circumferentially apart from each other. Each brace extends parallel with an axis of guide member 15. Alternately, guide roller support could be tubular in order to receive and surround a portion of guide member 15. Guide roller support 25 has a lower end that is spaced above the lower end of guide member 15, even during a minimum stroke position, as shown in FIG. 3. Guide roller support 25 is rigidly connected to frame 21 such that guide roller support 25 is stationary with frame 21 and riser 13. Decks 17, 19 and guide member 15 move axially upward and downward relative to guide roller support 25.

Upper and lower bearings 27, 29 are mounted to guide roller support 25 for rolling engagement with the exterior of guide member 15. Each bearing is preferably a set of rollers 27, 29, which comprises a plurality of rollers spaced circumferentially around guide member 15. Upper and lower rollers 27, 29 aid in the movement of guide member 15 relative to guide roller support 25 as guide roller support 25 moves axially upward and downward relative to guide roller support 25. In the preferred embodiment, rollers 27, 29 are axially spaced apart and mounted on the inner side of guide member 15. Axially spacing apart rollers 27, 29 helps to distribute forces from guide member 15 to guide roller support 25 so that riser tensioner assembly 11 transfers moment forces associated with movements of the production facility through guide member 15 and guide roller support 25 rather than directly to riser 13.

FIG. 1 shows tension assembly 11 in an intermediate position, with pistons 26 partly extended and frame 21 spaced above the upper end of guide member 15. In FIG. 2, the production vessel has moved downward or closer to the subsea well equipment 14 from the position in FIG. 1. Because riser mandrel 16 is stationary, pistons 26 have extended from the position in FIG. 1. The upper end of guide member 15 is farther from frame 21 than in FIG. 1. The upper end of guide member 15 is closer to the upper set of rollers 27 than in FIG. 1.

In FIG. 3, the production vessel has moved farther from the subsea well equipment 14 due to waves or current. Pistons 26 have contracted and the upper end of guide member 15 is substantially in contact with frame 21. Guide member 15 has moved upward such that the lower set of rollers 29 is now engaging guide member 15 near its lower end.

Although some embodiments of the present invention have been described in detail, it should be understood that various changes, substitutions, and alterations can be made hereupon without departing from the principle and scope of the invention. For example, rather than guide rollers to serve as the bearings, bushings could be used. Also, rather than a single, central guide member that receives the riser, a plurality of offset guide members could be employed. These offset guide members would not receive a riser, rather they would be mounted circumferentially around the riser, such as between some of the cylinder assemblies. A mating upper guide roller set would be mounted to the top frame for each offset guide member. In that instance the offset guide members would extend through the upper end of the top frame.

The invention claimed is:

1. A floating facility configured to apply a tension to a riser, the floating facility comprising:

a frame configured to be fixedly attached to the riser;

a platform including an upper deck and a lower deck, the upper deck and the lower deck having an opening configured to allow the riser to pass through the platform;

plural cylinder assemblies spaced around the opening, each cylinder assembly having a cylinder and a piston configured to slidably move inside the cylinder, the plural cylinder assemblies movably connecting the frame to the platform;

a guide member fixedly attached to the platform;

a guide roller support stationarily mounted to and extending from the frame; and at least one bearing fixedly attached to the guide roller support and configured to be in rolling engagement with the guide member as the platform moves relative to the frame.

2. The floating facility of claim 1, wherein the guide member is attached to the lower deck.

3. The floating facility of claim 1, wherein the cylinder assemblies are attached to the upper deck.

4. The floating facility of claim 1, wherein the guide member extends past the upper deck outside the platform.

5. The floating facility of claim 1, wherein the guide member extends past the upper deck towards the frame.

6. The floating facility of claim 1, wherein the guide member is tubular in cross section.

7. The floating facility of claim 1, wherein the guide member is configured to receive the riser.

8. The floating facility of claim 1, wherein the cylinder assemblies are parallel with the guide member.

9. A floating facility configured to apply a tension to a riser, the floating facility comprising:

a frame configured to be fixedly attached to the riser;

a platform having an opening configured to allow the riser to pass through the platform;

plural cylinder assemblies spaced around the opening, at least one cylinder assembly having a cylinder and a piston configured to slidably move inside the cylinder, the at least one cylinder assembly movably connecting the frame to the platform;

a guide member fixedly attached to the platform; and at least one bearing fixedly attached to the frame and in rolling engagement with the guide member as the platform moves relative to the frame.

10. The floating facility of claim 9, further comprising:

a guide roller support stationarily mounted to and extending from the frame and configured to hold the at least one bearing.

11. The floating facility of claim 9, wherein the platform has an upper deck and a lower deck.

12. The floating facility of claim 11, wherein the guide member is attached to the lower deck.

13. The floating facility of claim 11, wherein the guide member extends past the upper deck outside the platform.

14. The floating facility of claim 11, wherein the guide member extends past the upper deck towards the frame.

15. The floating facility of claim 9, wherein the guide member is tubular in cross section.

16. The floating facility of claim 9, wherein the guide member is configured to receive the riser.

17. The floating facility of claim 9, wherein the at least one bearing includes plural bearings.

18. The floating facility of claim 9, wherein the cylinder assemblies are parallel to the guide member.

19. A tensioner assembly for supporting a riser extending downwardly from a platform to a subsea wellhead, the tensioner assembly comprising:

a tension frame having a moveable guiding, stabilizing assembly for slidably engaging a track attachable to the platform for preventing lateral movement of the tensioner assembly due to a movement of a vessel;

a first deck for supporting a plurality of cylinders;

a plurality of pistons wherein each of the plurality of pistons engages the tension frame on one end; and a second deck securely supporting the track;

wherein the plurality of cylinders are secured to the first deck on one end and the plurality of cylinders is concentrically disposed around the downwardly extending riser from the tension frame, and wherein each of the plurality of cylinders is adapted for receiving one of the plurality of pistons; and wherein the tension frame is configured to move from a fully retracted position to a fully extended position and a plurality of positions therebetween using the moveable guiding, stabilizing assembly engaging the track and preventing lateral movement of the tension frame due to a movement of the vessel.

20. A floating facility configured to apply a tension to a riser, the floating facility comprising:

a frame configured to be fixedly attached to the riser;

a platform including an upper deck and a lower deck, the upper deck and the lower deck having an opening configured to allow the riser to pass through the platform;

plural cylinder assemblies spaced around the opening, each cylinder assembly having a cylinder and a piston configured to slidably move inside the cylinder, the plural cylinder assemblies movably connecting the frame to the platform;

a guide member fixedly attached to the platform;

means for supporting stationarily mounted to and extending from the frame; and means for rolling fixedly attached to the means for supporting and configured to be in rolling engagement with the guide member as the platform moves relative to the frame.

21. A floating facility configured to apply a tension to a riser, the floating facility comprising:

a frame configured to be fixedly attached to the riser;

a platform having an opening configured to allow the riser to pass through the platform;

plural cylinder assemblies spaced around the opening, at least one cylinder assembly having a cylinder and a piston configured to slidably move inside the cylinder, the at least one cylinder assembly movably connecting the frame to the platform;

a guide member fixedly attached to the platform; and means for rolling fixedly attached to the frame and in rolling engagement with the guide member as the platform moves relative to the frame.

22. A floating facility configured to apply a tension to a riser, the floating facility comprising:

means for holding the riser, the means for holding being configured to be fixedly attached to the riser;

means for supporting the means for holding, the means for supporting having an opening configured to allow the riser to pass through the means for supporting;

means for tensioning the means for holding, the means for tensioning being spaced around the opening, at least one means for tensioning having a cylinder and a piston configured to slidably move inside the cylinder, the at least one means for tensioning movably connecting the means for holding to the means for supporting;

means for guiding the means for holding, the means for guiding being fixedly attached to the means for supporting; and means for rolling along the means for guiding, the means for rolling being fixedly attached to the means for holding and in rolling engagement with the means for guiding as the means for supporting moves relative to the means for holding.

23. A method of tensioning a riser attached to a floating facility, the method comprising:

installing a riser tensioner on the floating facility, the riser tensioner being configured to include plural cylinder assemblies that movably connect a frame to a platform including an upper deck and a lower deck, the upper deck and the lower deck having an opening configured to allow the riser to pass through the platform, the plural cylinder assemblies being spaced around the opening, and each cylinder assembly having a cylinder and a piston configured to slidably move inside the cylinder;

fixedly attaching the frame to the riser;

engaging at least one bearing fixedly attached to the frame with a guide member fixedly attached to the platform such that the at least one bearing is in a rolling engagement with the guide member as the platform moves relative to the frame; and applying a tension to the pistons to tension the riser.

* * * * *